US012305951B2

(12) United States Patent
Weiss

(10) Patent No.: US 12,305,951 B2
(45) Date of Patent: May 20, 2025

(54) SYSTEM, APPARATUS, AND METHOD FOR COLLECTING AMMUNITION CASINGS

(71) Applicant: Michael Weiss, San Jose, CA (US)

(72) Inventor: Michael Weiss, San Jose, CA (US)

(73) Assignee: KINETIC ENERGY TOOLS, LLC, Salem, OR (US)

( * ) Notice: Subject to any disclaimer, the term of this patent is extended or adjusted under 35 U.S.C. 154(b) by 54 days.

(21) Appl. No.: 18/462,713

(22) Filed: Sep. 7, 2023

(65) Prior Publication Data

US 2024/0401893 A1 Dec. 5, 2024

Related U.S. Application Data

(60) Provisional application No. 63/505,537, filed on Jun. 1, 2023.

(51) Int. Cl.
*F41A 9/60* (2006.01)

(52) U.S. Cl.
CPC ..... *F41A 9/60* (2013.01)

(58) Field of Classification Search
CPC ..... F41A 9/60
USPC ..... 42/98
See application file for complete search history.

(56) References Cited

U.S. PATENT DOCUMENTS 3,153,981 A * 10/1964 Brass ..... F41A 9/60 42/98
3,618,458 A * 11/1971 Pruonto et al. ..... F41A 9/60 42/98
4,594,803 A * 6/1986 Muncy ..... F41A 9/60 42/98
6,530,169 B1 * 3/2003 Griffin ..... F41A 9/60 42/98
2002/0007581 A1 * 1/2002 Bucciarelli ..... F41G 1/35 42/98
2011/0107903 A1 5/2011 Ledbetter, III et al.
2018/0306538 A1 10/2018 DiSessa
2019/0195583 A1 6/2019 Vesich et al.

OTHER PUBLICATIONS

"M249 SAW/MK46/MK48—LOW/WIDE Brass Catcher", Tactical Brass Recovery, Web. 25, Mar. 2023. Retrieved from the Internet: <URL: https://www.tacticalbrassrecovery.com/m249-saw-mk46-mk48-low-wide-brass-catcher/>>.

International Search Report and Written Opinion issued in corresponding International Application No. PCT/US2024/032037, dated Sep. 18, 2024.

* cited by examiner

*Primary Examiner* — John Cooper
(74) *Attorney, Agent, or Firm* — Fox Rothschild LLP

(57) ABSTRACT

An apparatus for collecting spent ammunition casings from a weapon is disclosed. The apparatus has a support assembly, a container attached to the support assembly and forming a cavity configured to receive the ammunition casings, and a fastener configured to be received in a portion of a mounting fixture of the weapon and removably attach the support assembly to the mounting fixture. The fastener is either a replacement fastener or a modified fastener of a mounting fixture fastener of the weapon.

20 Claims, 10 Drawing Sheets

SYSTEM, APPARATUS, AND METHOD FOR COLLECTING AMMUNITION CASINGS

RELATED APPLICATIONS

This application claims the benefit of U.S. Provisional Patent Application No. 63/505,537 filed on Jun. 1, 2023, which is hereby incorporated by reference in its entirety.

TECHNICAL FIELD

The present disclosure generally relates to a system, apparatus, and method for collecting casings, and more particularly to a system, apparatus, and method for collecting casings of spent ammunition.

BACKGROUND

After ammunition is expended by a firearm, empty casings (e.g., casings and/or casing links) are typically ejected from the firearm. Certain types of firearms such as military-grade automatic weapons may eject many casings at high velocities. For example, these types of weapons may eject casings of spent ammunition at high velocities in a spraying manner that may cover an arc surrounding the firing weapon (e.g., 10-12 feet by 10-12 feet). Such casing ejection may present a safety concern for personnel located in the vicinity of the firing weapon.

Conventional shell collectors include various different types. One type operates similar to a sweeper cleaner. The user rolls the brass collector over the shells that are then captured by a rolling bristle. Another type is a compact version of the sweeper-style apparatus. A further type includes a collector that attaches directly to a firearm, which adds weight to the firearm and wears on a firearm's surface.

However, conventional shell collectors do not easily attach to a vehicle or other assembly. Further, conventional collectors do not provide an effective technique for collecting relatively large amounts of empty casings dispensed from a vehicle-mounted firearm.

The exemplary disclosed system, apparatus, and method are directed to overcoming one or more of the shortcomings set forth above and/or other deficiencies in existing technology.

SUMMARY OF THE DISCLOSURE

In one exemplary aspect, the present disclosure is directed to an apparatus for collecting spent ammunition casings (e.g., casings and/or casing links) from a weapon. The apparatus includes a support assembly, a container attached to the support assembly and forming a cavity configured to receive the ammunition casings, and a fastener configured to be received in a portion of a mounting fixture of the weapon and removably attach the support assembly to the mounting fixture. The fastener is either a replacement fastener or a modified fastener of a mounting fixture fastener of the weapon.

In another aspect, the present disclosure is directed to a method for collecting spent ammunition casings (e.g., casings and/or casing links) from a weapon. The method includes providing a support assembly, attaching a container to the support assembly and forming a cavity configured to receive the ammunition casings when the container is attached to the support assembly, and removably attaching the support assembly to the weapon by inserting a fastener through a portion of a mounting fixture of the weapon and a portion of the support assembly. The fastener is either a replacement fastener or a modified fastener of a mounting fixture fastener of the weapon.

DETAILED DESCRIPTION AND INDUSTRIAL APPLICABILITY

The exemplary disclosed system, apparatus, and method may be a system, apparatus, and method for collecting casings (e.g., casings and/or casing links) of spent ammunition. The exemplary disclosed apparatus may include an assembly for collecting casings that may include a frame assembly. The frame assembly may include a support assembly that includes a plurality of support members and a container. The apparatus may also include a pin assembly for connecting the frame assembly to a weapon and/or a mount such as a vehicle mount or a mount of a structure.

Figure 1:
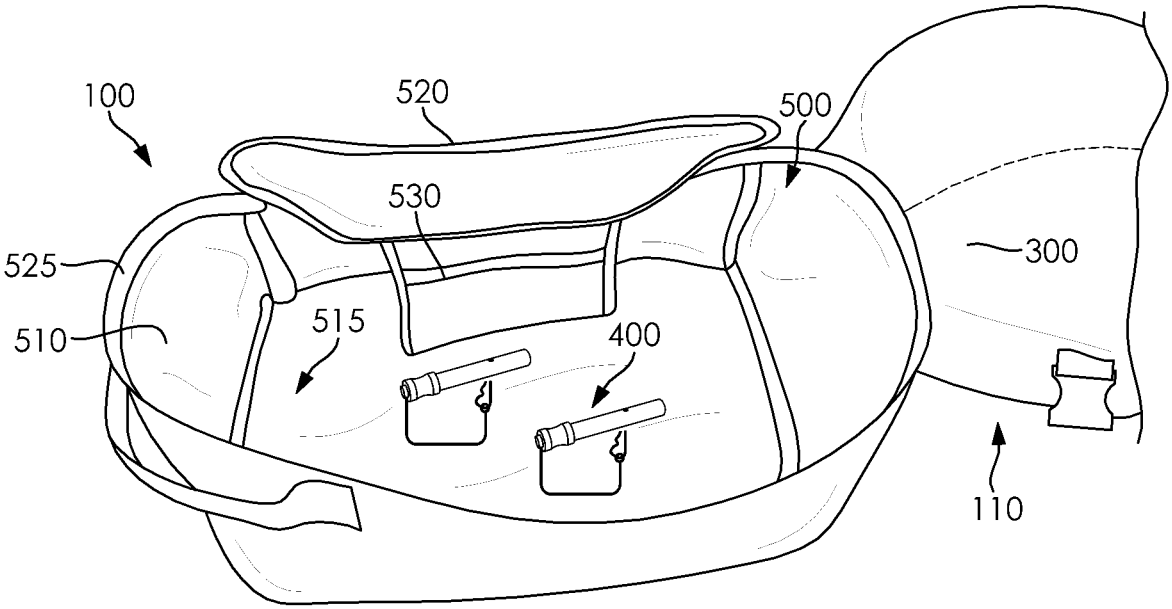
FIG. 1 illustrates a perspective view of at least some exemplary embodiments of the present disclosure.
Figure 2:
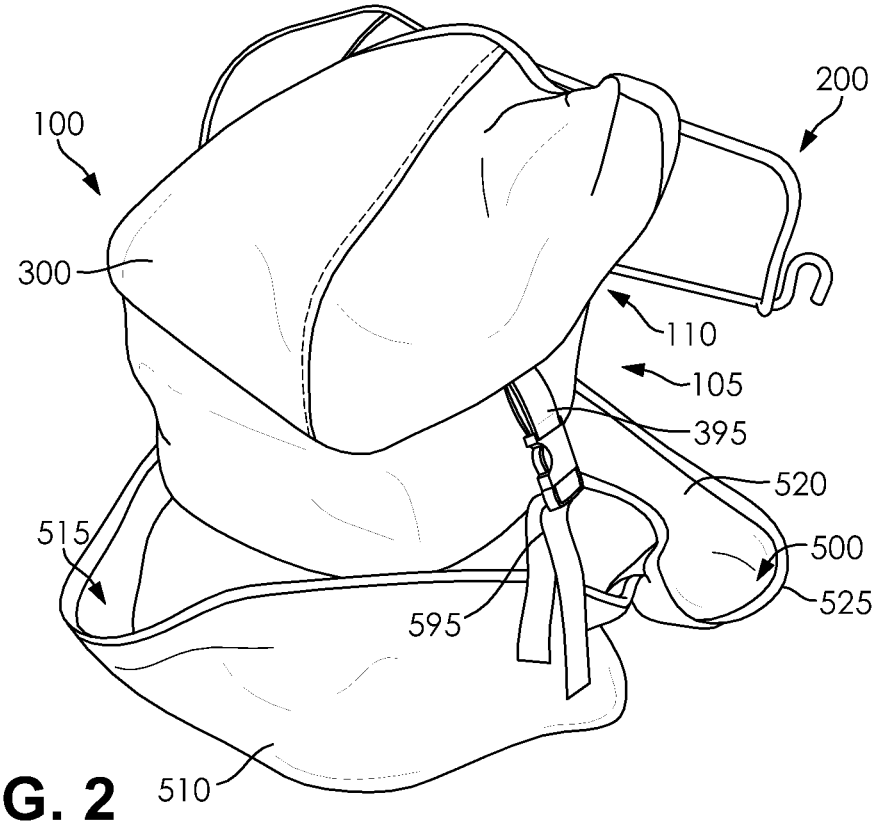
FIG. 2 illustrates a perspective view of at least some exemplary embodiments of the present disclosure.

The system, apparatus, and method may include a system 100 including an apparatus 105 having a frame assembly 110 for example as illustrated in FIGS. 1 and 2. Frame assembly 110 may include a support assembly 200 and a container 300 that may be supported by support assembly 200. Apparatus 105 may also include a fastener assembly 400 that may removably attach frame assembly 110 to a weapon and/or a mount. Apparatus 105 may also include a housing 500 that may house components of apparatus 105 and may also act as a catch to help dispose of casings for example as described further below.

Figure 4A:
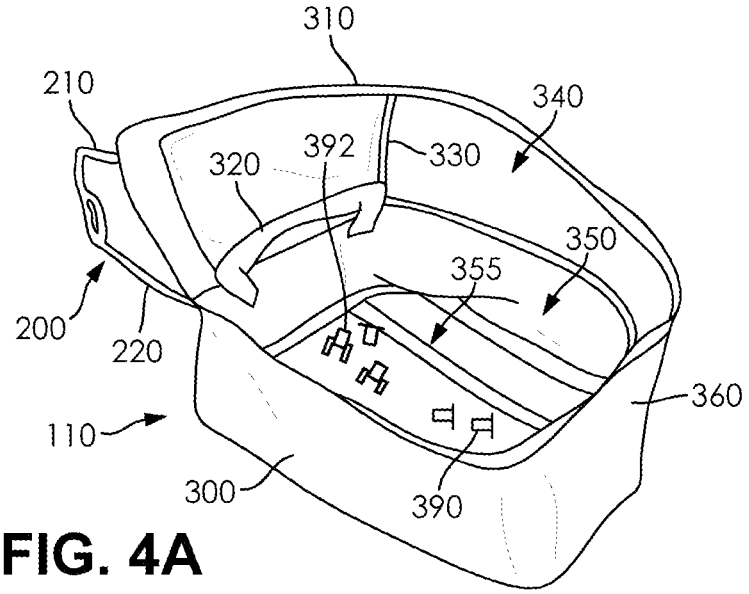
FIG. 4A illustrates a perspective view of at least some exemplary embodiments of the present disclosure.

Container 300 may be removably received on (e.g., removably attached to) support assembly 200. As illustrated in FIGS. 2, 4A, and 4C, support assembly 200 may support container 300 in an expanded (e.g., open) configuration for collecting casings (e.g., casings and/or casing links). As illustrated in FIGS. 5A, 5B, and 5C, support assembly 200 may include a plurality of support members that may be attached together via any suitable technique such as via welding, adhesive, mechanical fasteners (e.g., bolts or screws), and/or any other suitable fastening method. Support assembly 200 may also include a plurality of integrally formed support members. Support assembly 200 may be formed from any suitable structural materials such as, for example, metal (e.g., steel material such as stainless steel), structural plastic material, composite material, wood, wire (e.g., metal or plastic wire), and/or any other suitable structural material for maintaining container 300 in a desired shape and/or configuration. In at least some exemplary embodiments, support assembly 200 may be a wire assembly including a plurality of wire members such as, for example, metal wire members.

Figure 12:
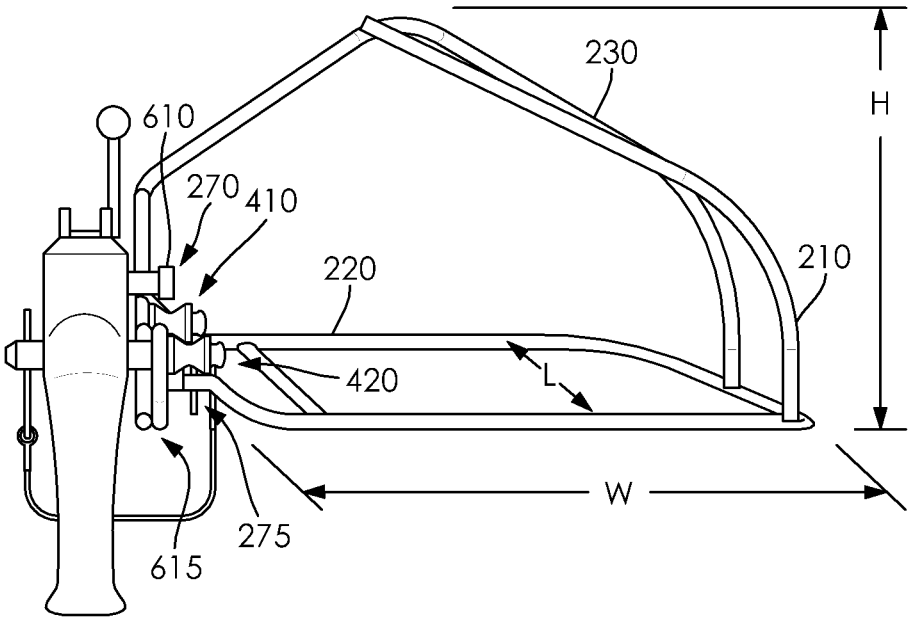
FIG. 12 illustrates a perspective view of at least some exemplary embodiments of the present disclosure.
Figure 13:
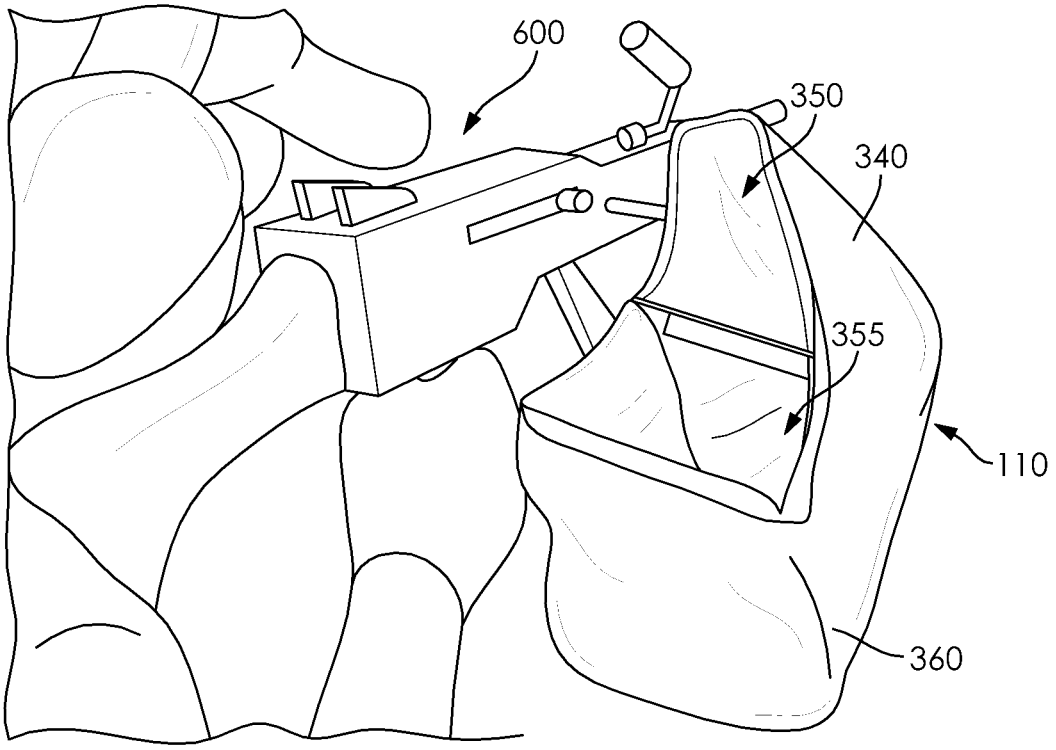
FIG. 13 illustrates a perspective view of at least some exemplary embodiments of the present disclosure.

Support assembly 200 may include a frame member 210, a hanging member 220, a support member 230, and a bent member 240. Members 210, 220, 230, and 240 may be dimensioned and configured in any suitable manner such as, for example, as illustrated in the exemplary disclosed configuration of FIGS. 5A, 5B, and 5C. For example, frame member 210 and support member 230 may be bent and attached to each other (e.g., at a first attachment portion 250), frame member 210 may be attached to hanging member 220 (e.g., at a second attachment portion 255), support member 230 may be attached to hanging member 220 (e.g., at a third attachment portion 260), and bent member 240 may be attached to hanging member 220 (e.g., at a fourth attachment portion 265), to form a frame for supporting container 300. Support assembly 200 may also be dimensioned and configured to be removably attachable to any desired weapon (e.g., to be shaped so as to fit with components and/or a shape of a desired weapon and/or mount). As illustrated in FIG. 12, support assembly 200 may form a frame having a height H of between about 4 inches and about 8 inches (e.g., between about 6 inches and about 7 inches), a length L of between about 8 inches and about 16 inches (e.g., between about 10 inches and about 14 inches), and a width W of between about 6 inches and about 12 inches (e.g., between about 8 inches and about 10 inches).

Returning to FIGS. 5A, 5B, and 5C, hanging member 220 of support assembly 200 may include a plurality of fastening portions for removably attaching support assembly 200 (e.g., and frame assembly 110) to a weapon and/or a mount. End portions of hanging member 220 may be formed as fastening portions (e.g., and/or fastening portions may be formed on any other suitable member of support assembly 200). For example, hanging member 220 may include a first fastening portion 270 and a second fastening portion 275. Fastening portions 270 and 275 may have any suitable configuration for removably attaching to a weapon and/or mount such as, for example, a hook, a pin, an eyelet, threading, an aperture, a mechanical fastener, and/or any other suitable configuration. In at least some exemplary embodiments, fastening portions 270 and 275 may each be a hooked portion for example as illustrated in FIGS. 5A, 5B, and 5C. Fastening portions 270 and 275 may each receive a component of fastener assembly 400 for example as described below.

As illustrated in FIGS. 5B and 5C, fastener assembly 400 may include a plurality of fasteners. For example, fastener assembly 400 may include a first fastener 410 that may be removably received in first fastening portion 270 and a second fastener 420 that may be removably received in second fastening portion 275. Fasteners 410 and 420 may be formed from material similar to as described above regarding support assembly 200. First fastener 410 may include a fastener body 412 (e.g., a pin) that may be attached to a cotter pin 414 by a lanyard 416. Second fastener 420 may include a fastener body 422 (e.g., a pin) that may be attached to a cotter pin 424 by a lanyard 426. When first fastener 410 is received in first fastening portion 270, cotter pin 414 may be received in an aperture 418 of fastener body 412 so that first fastener 410 may be secured in first fastening portion 270 for example as schematically illustrated in FIG. 5C (e.g., weapon and/or mount components not shown for clarity). When second fastener 420 is received in second fastening portion 275, cotter pin 424 may be received in an aperture 428 of fastener body 422 so that second fastener 420 may be secured in second fastening portion 275 for example as schematically illustrated in FIG. 5C (e.g., weapon and/or mount components not shown for clarity). Fastening portions 270 and 275 may be respectively configured to hold respective fasteners 410 and 420 (e.g., so that fasteners 410 and 420 do not slip out of respective fastening portions 270 and 275) when cotter pins 414 and 424 are received in respective apertures 418 and 428 for example as illustrated in FIG. 5C. Each of fastener bodies 412 and 422 may have one or more (e.g., a plurality of) respective apertures 418 and 428.

In at least some exemplary embodiments, fastener bodies 412 and 422 may be alloy steel pins. Also for example, fastener bodies 412 and 422 may be 12 mm pins. For example, fastener bodies 412 and 422 may be black oxide pins. Also for example, lanyards 416 and 426 may be galvanized steel lanyards. Additionally for example, lanyards 416 and 426 may be wire rope lanyards that may be attached to end portions of respective fastener bodies 412 and 422 by thread-locking fasteners (e.g., a screw or a bolt such as a thread-locking pan head Phillips screw). Further for example, cotter pins 414 and 424 may be hairpin cotter pins.

Figure 6:
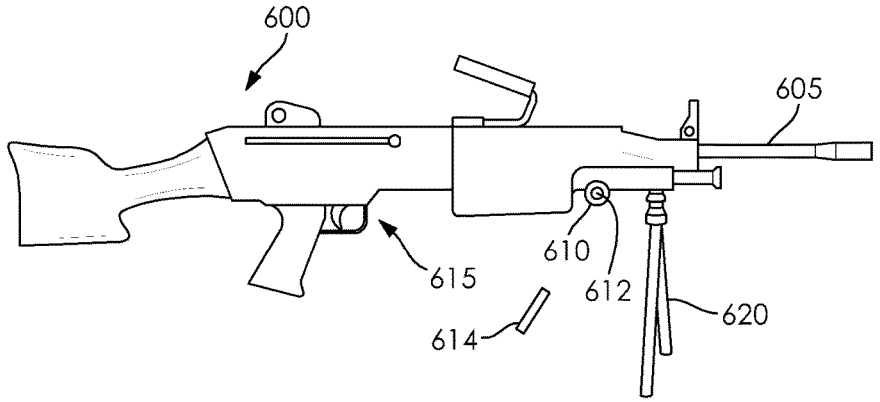
FIG. 6 illustrates a side view of at least some exemplary embodiments of the present disclosure.

Frame assembly 110 (e.g., support assembly 200) may be attached to a weapon 600 (e.g., as illustrated in FIG. 6) via fastener assembly 400. Weapon 600 may be a firearm that ejects casings (e.g., casings and/or casing links) when fired. Weapon 600 may be any desired weapon such as, for example, an automatic firearm such as a machine gun. For example, weapon 600 may be a M249 SAW light machine gun, a 0.50 caliber machine gun (e.g., M2), an M60 machine gun, an MK-19 grenade launcher, or any other suitable type of firearm. For example as illustrated in FIG. 6, weapon 600 may be an M249 SAW having a barrel 605, a mounting fixture 610, a trigger assembly 615, and a bipod 620. When fired by a user (e.g., an operator), weapon 600 may eject spent casings (e.g., at relatively high velocities) that may be collected by frame assembly 110.

Figure 7:
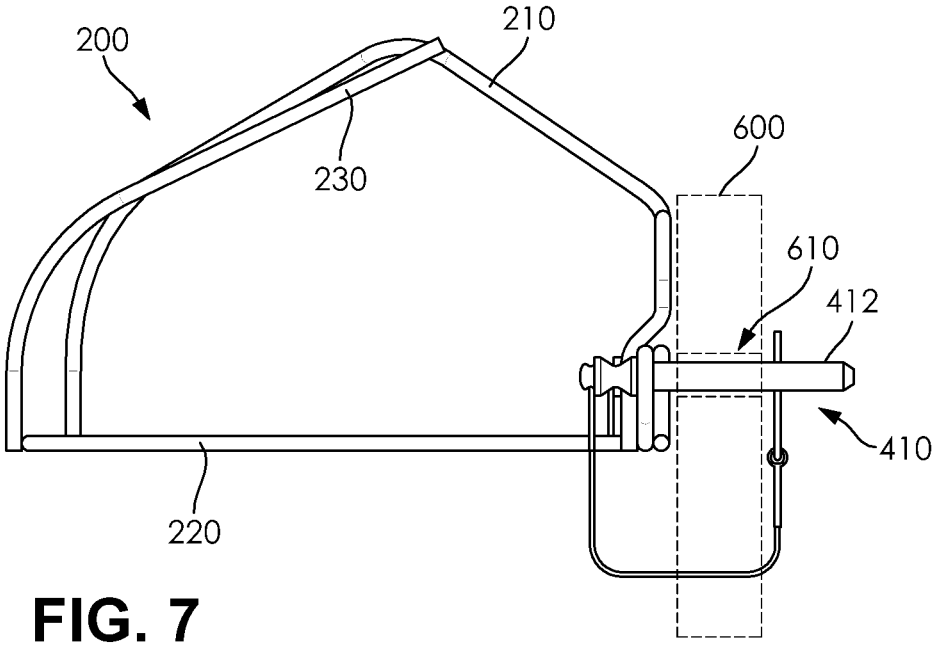
FIG. 7 illustrates a front view of at least some exemplary embodiments of the present disclosure.
Figure 8:
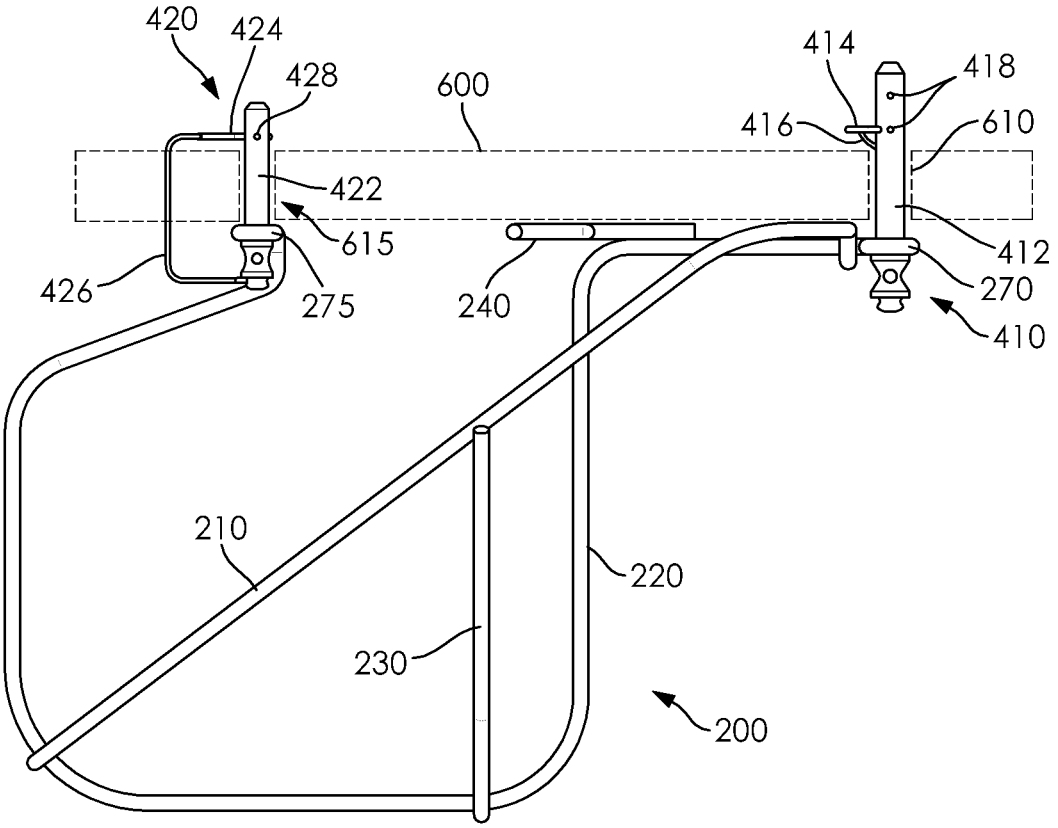
FIG. 8 illustrates a top view of at least some exemplary embodiments of the present disclosure.
Figure 9:
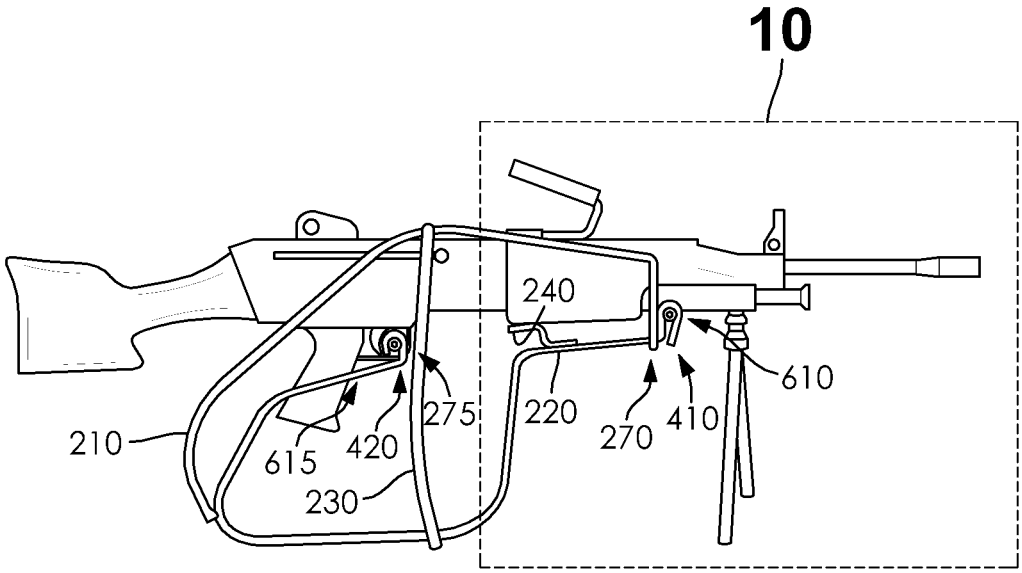
FIG. 9 illustrates a perspective view of at least some exemplary embodiments of the present disclosure.
Figure 10:
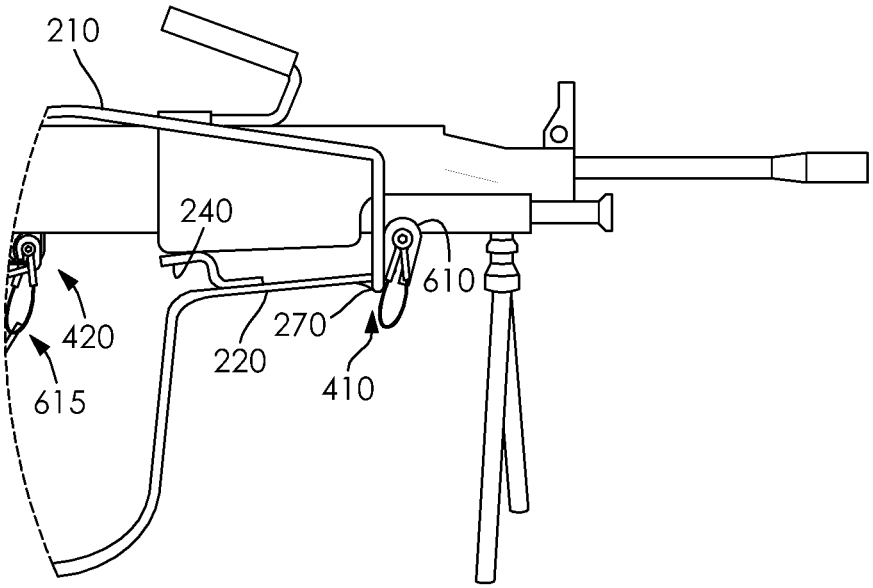
FIG. 10 illustrates a detailed, perspective view of at least some exemplary embodiments of the present disclosure.
Figure 11:
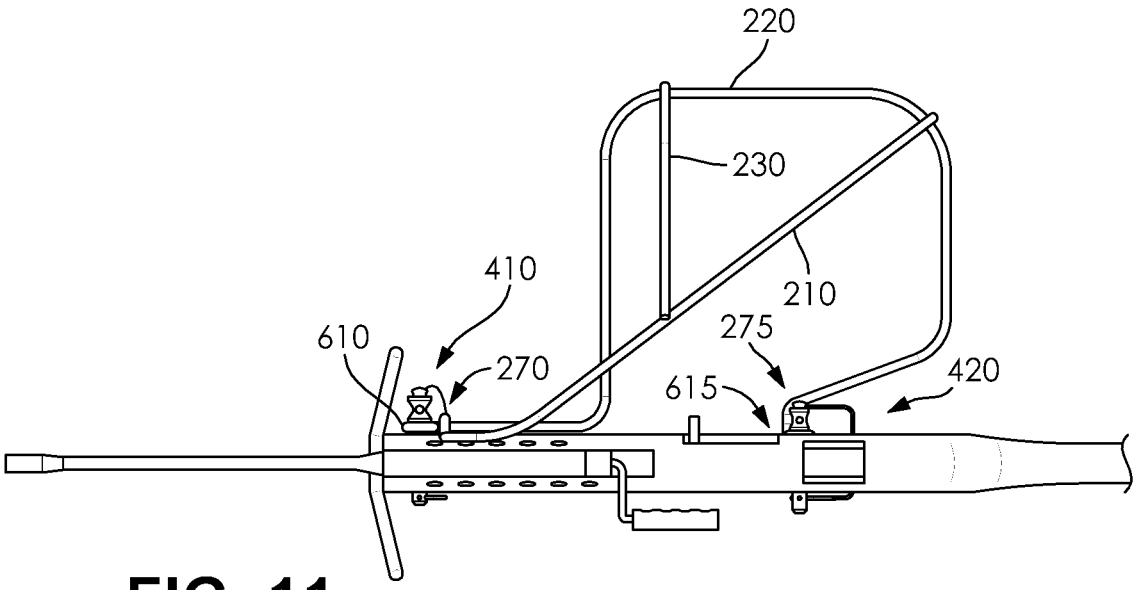
FIG. 11 illustrates a top view of at least some exemplary embodiments of the present disclosure.

As schematically illustrated in FIGS. 7 and 8, fasteners 410 and 420 of fastener assembly 400 may removably attach (e.g., removably fasten) support assembly 200 (e.g., frame assembly 110) to weapon 600. First fastener 410 may be received at (e.g., through) first fastening portion 270 of support assembly 200 and mounting fixture 610 of weapon 600, and second fastener 420 may be received at (e.g., through) second fastening portion 275 of support assembly 200 and trigger assembly 615 of weapon 600, to attach support assembly 200 to weapon 600.

As illustrated in FIGS. 5C, 8, and 9-12, first fastener 410 may be received through first fastening portion 270 of support assembly 200 and also through mounting fixture 610 of weapon 600, with cotter pin 414 being received in aperture 418 to secure first fastener 410 in place and to thereby attach first fastening portion 270 of support assembly 200 to mounting fixture 610. Second fastener 420 may be received through second fastening portion 275 of support assembly 200 and also at (e.g., through a portion of) trigger assembly 615 of weapon 600 (e.g., or any other suitable location), with cotter pin 424 being received in aperture 428 to secure second fastener 420 in place and to thereby attach second fastening portion 275 of support assembly 200 to trigger assembly 615. Support assembly 200 (e.g., frame assembly 110) may thereby be securely, removably fastened to weapon 600 at two points of weapon 600 (e.g., at mounting fixture 610 and trigger assembly 615). Support assembly 200 may also be similarly attached to any other suitable portions of weapon 600. Also, mounting fixture 610 may include a mounting fixture aperture 612 (e.g., as illustrated in FIG. 6) configured to receive a mounting fixture fastener 614 of weapon 600. For example, mounting fixture fastener 614 may be a fastener issued with and/or compatible with mounting fixture aperture 612 to mount weapon 600 to a desired location (e.g., a mount) via mounting fixture fastener 614 being received in mounting fixture aperture 612 and an aperture of any suitable mount or mounting structure (e.g., of a vehicle, a structure, and/or a weapon support stand). First fastener 410 may be a replacement fastener for, or a modified fastener of, mounting fixture fastener 614. For example, first fastener 410 may be a modified fastener that may be machined (e.g., drilled) to provide aperture 418 (e.g., aperture 428 of second fastener 420 may be similarly machined). Also for example, additional apertures may be provided at an end portion (e.g., a top end portion) of fastener bodies 412 and 422 to facilitate removal of fasteners 410 and 420 (e.g., using a casing and/or ammunition as a tool or lever using the additional apertures) should they become stuck in mounting fixture aperture 612 and/or other locations of weapon 600.

Figure 14:
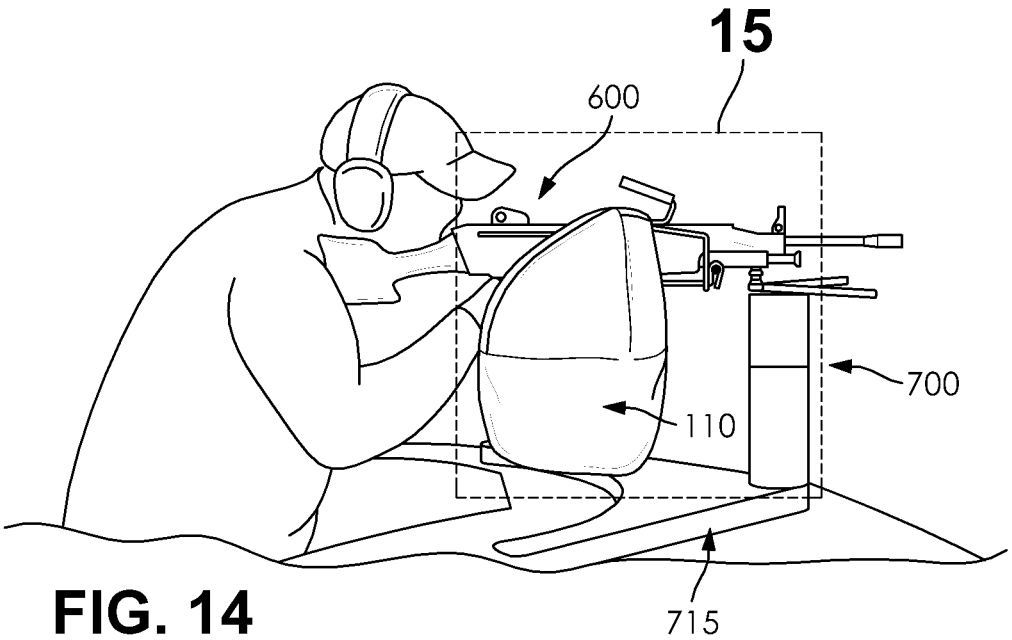
FIG. 14 illustrates a side view of at least some exemplary embodiments of the present disclosure.
Figure 15:
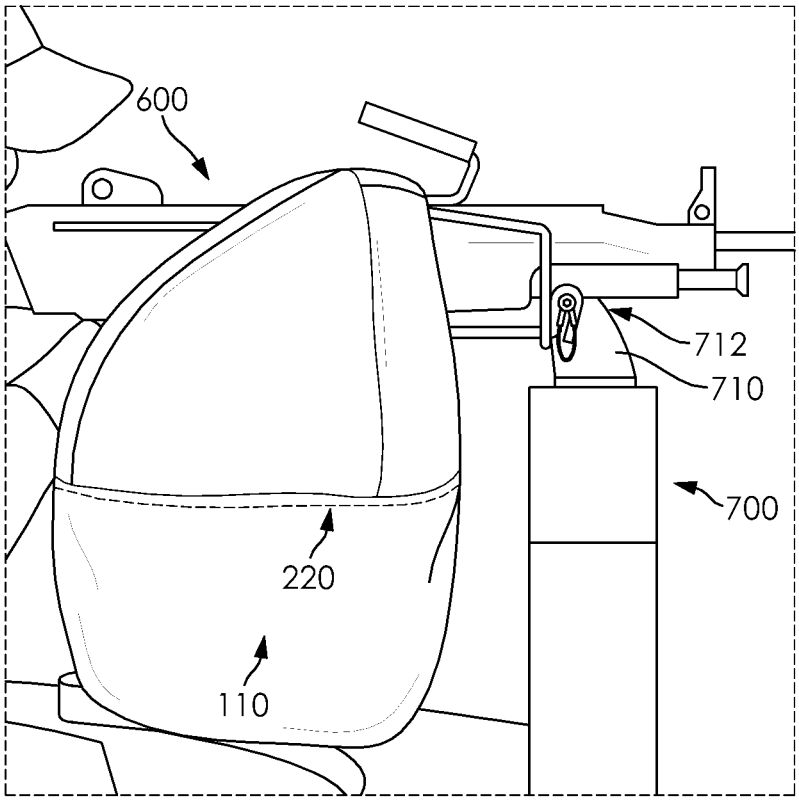
FIG. 15 illustrates a detailed, side view of at least some exemplary embodiments of the present disclosure.

As illustrated in FIG. 15, first fastener 410 may also be additionally received at a mount 700 when weapon 600 is attached to mount 700. Mount 700 may attach weapon 600 to a support body 715 (e.g., any suitable vehicle or a structure for example as illustrated in FIG. 14) such as, for example, a military vehicle (e.g., land vehicle, aircraft, or maritime vessel) or any other suitable vehicle or structure to which a weapon system may be attached. For example, mount 700 may attach weapon 600 to support body 715 such as a vehicle, a fighting position such as a bunker, or any other suitable location for mounting a weapon. In at least some exemplary embodiments, mount 700 may attach weapon 600 to support body 715 such as a Humvee or any other desired vehicle or structure. For example, weapon 600 and apparatus 105 may be integrated (e.g., fully integrated) into mount 700 (e.g., a vehicle mount such as, for example, a ground vehicle or aircraft machine gun mount such as a ground vehicle or helicopter machine gun mount). When weapon 600 is attached to mount 700, first fastener 410 may be received at (e.g., through) first fastening portion 270 of support assembly 200, at a mount portion 710 (e.g., through an aperture 712 or any other suitable attachment location of mount portion 710 for example similar to mounting fixture 610), and also through mounting fixture 610 of weapon 600 for example as illustrated in FIG. 15. Cotter pin 414 may be received in aperture 418 to secure first fastener 410 in place and to thereby attach first fastening portion 270 of support assembly 200 to both mount portion 710 and mounting fixture 610. In at least some exemplary embodiments, second fastener 420 may removably attach second fastening portion 275 to trigger assembly 615 for example as described above.

In at least some exemplary embodiments, first fastener 410 and/or second fastener 420 may be replacement fasteners that replace fasteners (e.g., mounting fixture fastener 614) that may be associated with weapon 600 and/or mount 700. For example, first fastener 410 and/or second fastener 420 may be new fasteners that may be configured to replace fasteners (e.g., mounting fixture fastener 614) associated with weapon 600 (e.g., fasteners from kits that may be provided with weapon 600, for example based on military equipment issue). Also for example, first fastener 410 and/or second fastener 420 may be modified fasteners that may be modified versions of fasteners associated with weapon 600 (e.g., fasteners from kits that may be provided with weapon 600, e.g., mounting fixture fastener 614). For example, first fastener 410 and/or second fastener 420 may be modified fasteners that may be altered (e.g., machined) versions of fasteners associated with weapon 600 (e.g., modified versions of fasteners issued with weapon 600 such as mounting fixture fastener 614). For example, apertures 418 and/or 428 may be added to fasteners associated with weapon 600 (e.g., mounting fixture fastener 614) to provide respective fasteners 410 and/or 420.

Referring back to FIGS. 4A, 4B, and 4C, support assembly 200 may support container 300 in an expanded (e.g., open) configuration for collecting casings (e.g., casings and/or casing links) ejected by weapon 600 when weapon 600 is operated (e.g., fired) by a user. Container 300 may be formed from flexible material (e.g., clastic material or material that may not be rigid) such as fabric or textile material. For example, container 300 may be formed from nylon material such as nylon fabric material, cloth material, canvas material, and/or any other suitable material. For example, container 300 may be formed from vinyl material, polyester material, acrylic material, and/or any other suitable material. In at least some exemplary embodiments, container 300 may be formed from CORDURA® available from INVISTA of Kansas, United States, or material similar to CORDURA®. In at least some exemplary embodiments, container 300 may be formed from inflexible, rigid, and/or stiff material.

Container 300 may be removably attached or fixedly attached to support assembly 200 to form frame assembly 110. For example, container 300 may include a frame attachment line 310 that may be attached to frame member 210 and a hanging attachment line 320 that may be attached to hanging member 220. Also in at least some exemplary embodiments, container 300 may include a support attachment line 330 that may be attached to (e.g., and/or be disposed adjacent to) support member 230. Attachment lines 310, 320, and 330 may be removably or fixedly attached to support assembly 200 via hook and loop fasteners (e.g., VELCRO® available from the Velcro Companies), magnetic fasteners, stitching, mechanical fasteners such as buttoning fasters, zippers, and/or any other suitable technique for removably or fixedly attaching container 300 to respective members 210, 220, and/or 230.

Based on attachment to support assembly 200, container 300 may be maintained in a desired shape for example as illustrated in FIG. 4A. For example, an upper portion 340 of container 300 may be supported by frame member 210 (e.g., based on attachment of frame attachment line 310 to frame member 210) to form an opening 350 that may provide an opening to a cavity 355 of container 300. Cavity 355 may be formed by a lower portion 360 of container 300 that may hang from hanging member 220 (e.g., based on attachment of hanging attachment line 320 to hanging member 220). For example, lower portion 360 may hang freely from hanging member 220 based on attachment of hanging attachment line 320 to hanging member 220. Spent casings (e.g., casings and/or casing links) ejected from weapon 600 may move (e.g., fly) through opening 350 and be collected (e.g., caught) in cavity 355.

Figure 4B:
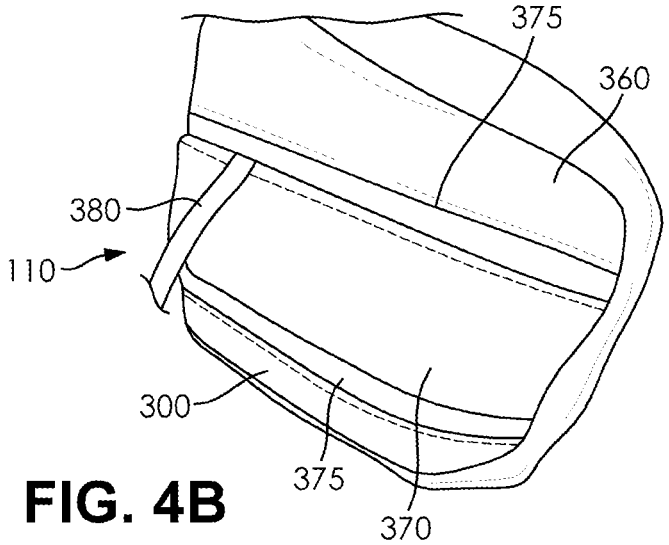
FIG. 4B illustrates a bottom view of the exemplary embodiment illustrated in FIG. 4A.
Figure 4C:
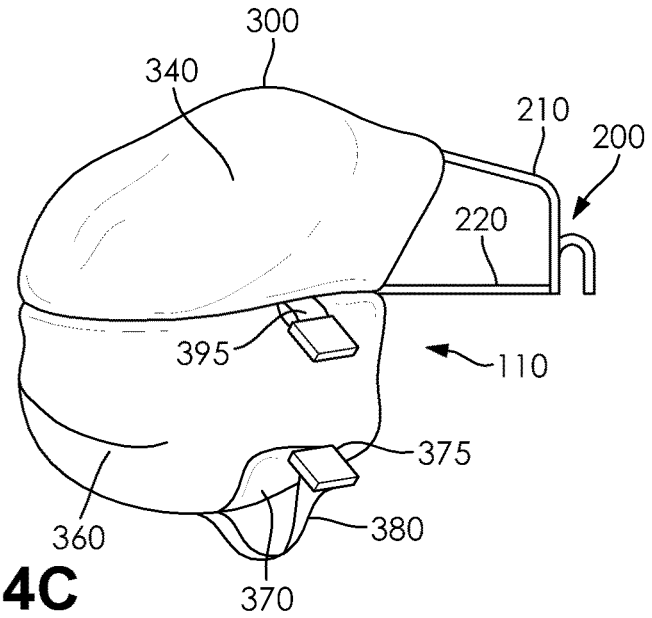
FIG. 4C illustrates a side view of the exemplary embodiment illustrated in FIG. 4A.
Figure 5A:
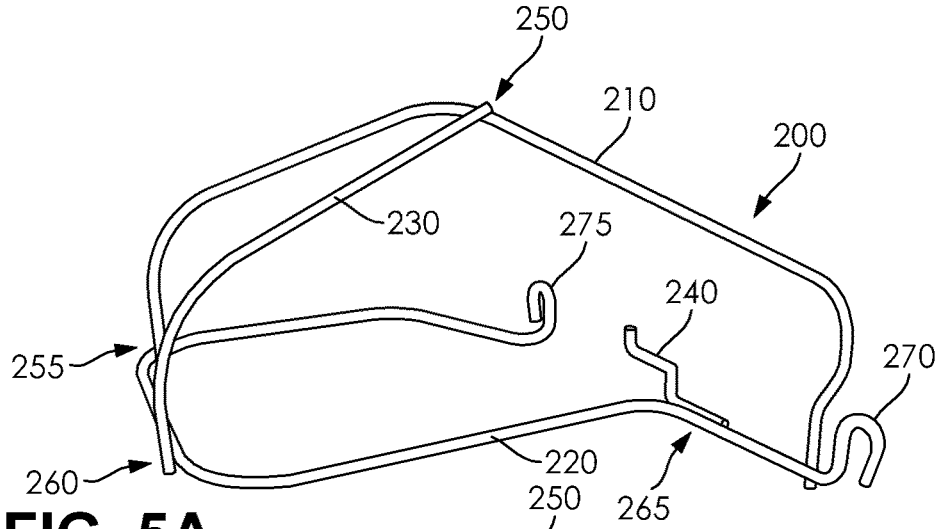
FIG. 5A illustrates a perspective view of at least some exemplary embodiments of the present disclosure.
Figure 5B:
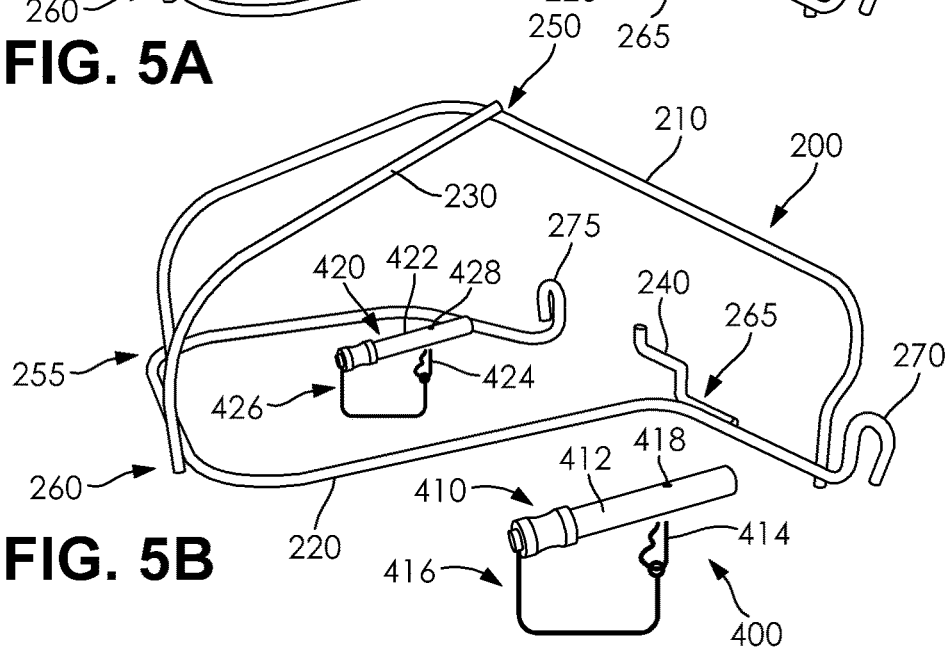
FIG. 5B illustrates an exploded, perspective view of at least some exemplary embodiments of the present disclosure.
Figure 5C:
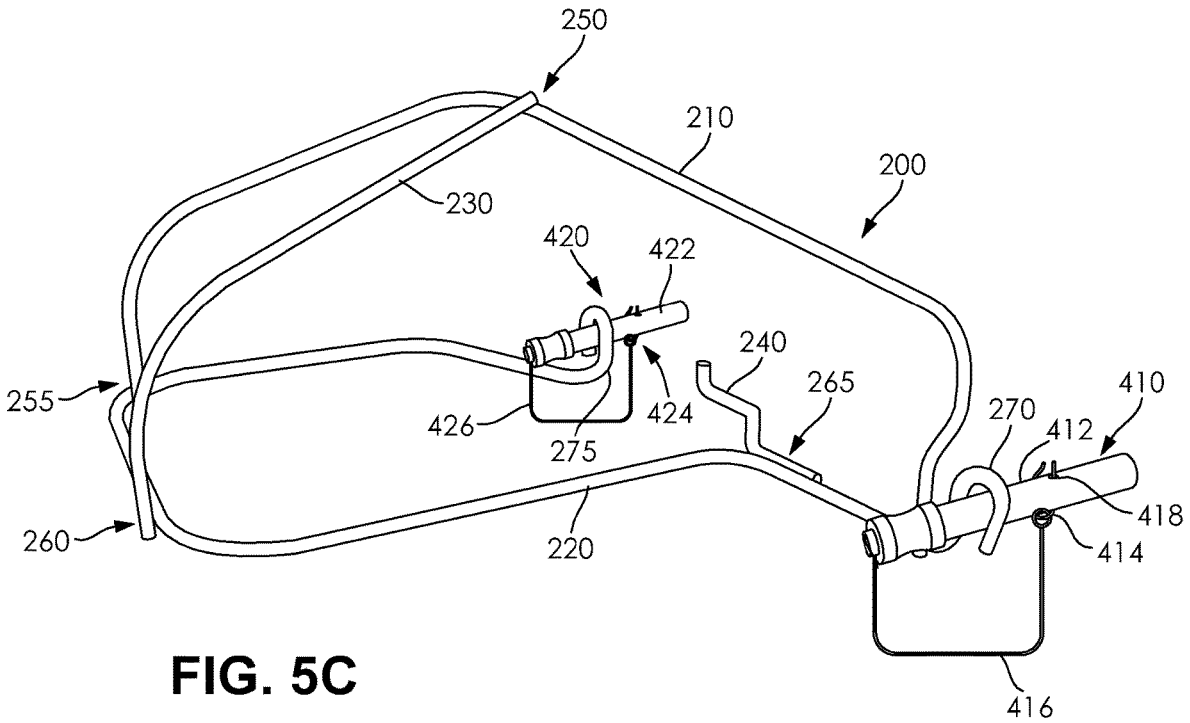
FIG. 5C illustrates a perspective view of at least some exemplary embodiments of the present disclosure.

As illustrated in FIGS. 4B and 4C, lower portion 360 of container 300 may include a flap portion 370. Flap portion 370 may be partially or substantially entirely removably attachable to lower portion 360. For example, some of or substantially an entire perimeter of flap portion 370 may be removably attachable to lower portion 360 via one or more container fasteners 375. Container fastener 375 may be a rapid detachment fastener that may allow for relatively rapid detachment of flap portion 370 from lower portion 360. Container fastener 375 may be a hook and loop fastener, a zipper, a plurality of buttons, a press-fit or snap-fit fastener, and/or any other suitable fastener. Container fastener 375 may include a handle 380 that may allow a user to easily grasp and detach flap portion 370 from lower portion 360. In at least some exemplary embodiments, an attached portion of flap portion 370 may remain attached to lower portion 360 when a user uses container fastener 375 to separate at least a portion of flap portion 370 from lower portion 360. When container fastener 375 is used to detach at least a portion of flap portion 370 from lower portion 360, some, most, or substantially all casings (e.g., casings 390 and/or casing links 392) ejected from weapon 600 and contained (e.g., caught) in cavity 355 may fall out of cavity 355. Container 300 may further have one or more (e.g., a plurality of) first connecting fasteners 395 that may be removable attached to a fastener of housing 500 for example as described below.

Figure 3:
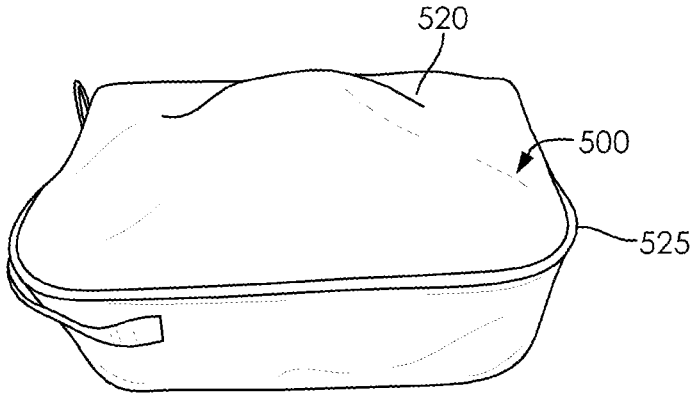
FIG. 3 illustrates a perspective view of at least some exemplary embodiments of the present disclosure.

Referring back to FIGS. 1-3, housing 500 may be formed from similar material as container 300. Housing 500 may include a housing body 510 that may be configured to form a housing cavity 515 and a housing cover 520 having at least a portion that may be removably attachable to housing body 510 via a housing fastener 525 that may be generally similar to attachment lines 310, 320, and 330 and/or container fastener 375.

Housing 500 may act as a carrying case for apparatus 105 when apparatus 105 is being stored and/or transported. For example, frame assembly 110 (e.g., including support assembly 200 and container 300) and fastener assembly 400 may be housed in housing cavity 515 when not in use. Housing 500 may for example include a compartment 530 for storing some components of apparatus 105 such as, for example, fastener assembly 400.

Housing 500 may also act as a catcher case for system 100. For example, housing 500 may include one or more (e.g., a plurality of) second connecting fasteners 595 that may be removably attached to corresponding first connecting fasteners 395 of container 300. Connecting fasteners 395 and 595 may be any suitable fastening components that removably attach to each other such as, for example, buckles, snap-fit connectors, hook and loop fasteners, magnetic fasteners, and/or any other suitable fastening components. Housing 500 may be removably attached under (e.g., may be disposed underneath or hang underneath) container 300 via connecting fasteners 395 and 595 for example as illustrated in FIG. 2. When flap portion 370 is removably detached from lower portion 360 of container 300, casings (e.g., casings 390 and/or casing links 392) contained in cavity 355 of container 300 may fall through an aperture provided by detached flap portion 370 and be collected (e.g., caught) in housing cavity 515 of housing 500.

For example when a user is actively firing weapon 600 to fill cavity 355 of container 300 with casings (e.g., casings 390 and/or casing links 392) over a period (e.g., an extended period) of time, housing 500 may be attached to container 300 via connecting fasteners 395 and 595. As cavity 355 becomes increasingly filled, a user may detach flap portion 370 (e.g., by grasping handle 380 and opening container fastener 375) so that casings (e.g., casings 390 and/or casing links 392) fall out of cavity 355 and into housing cavity 515 of housing 500. Flap portion 370 may then be reattached to lower portion 360 of container 300 so that further casings (e.g., casings 390 and/or casing links 392) do not fall out of container 300. Housing 500 may be detached from container 300 (e.g., by detaching connecting fasteners 395 and 595), and housing 500 may be brought by a user (e.g., a single user that is firing weapon 600 may stop firing to dispose of casings, or a second user may dispose of casings while a first user may still be firing weapon 600) to a disposal area (e.g., a container or other housing into which large amount of spent casings may be emptied) or any other desired location. Casings (e.g., casings 390 and/or casing links 392) disposed in housing cavity 515 of housing 500 may be emptied. Housing 500 may be attached again to container 300, which may be becoming increasingly filled by that point, and the process may be repeated for as many iterations as desired. Weapon 600 may thereby operate over an extended period of time with large amounts (e.g., extremely large amounts) of spent casings (e.g., casings 390 and/or casing links 392) being continuously removed from an area of weapon 600, which may be continuously firing.

The exemplary disclosed system, apparatus, and method may be used in any suitable application involving firearms. Also for example, the exemplary disclosed system, apparatus, and method may be used in any suitable application involving ammunition or munitions. Further for example, the exemplary disclosed system, apparatus, and method may be used in any suitable application involving collecting casings (e.g., casings and/or casing links) from expended ammunition fired by firearms.

Figure 16:
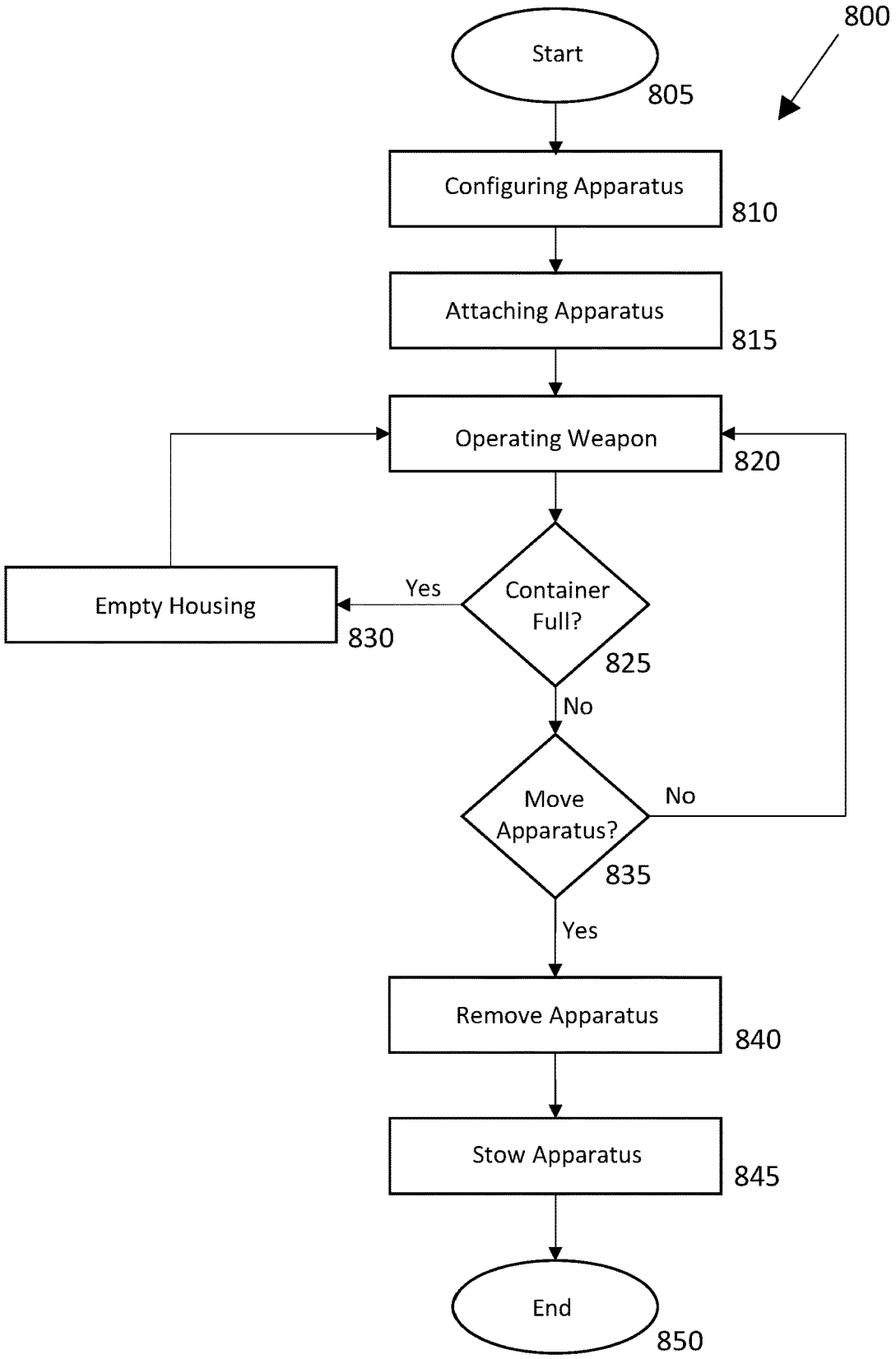
FIG. 16 illustrates an exemplary process of at least some exemplary embodiments of the present disclosure.

FIG. 16 illustrates an exemplary operation of the exemplary disclosed system 100. Process 800 begins at step 805. At step 810, apparatus 105 may be configured. For example when frame assembly 110 (e.g., including support assembly 200 and container 300) and fastener assembly 400 are stowed in housing 500, housing fastener 525 may be opened to open housing cover 520 relative to housing body 510, and frame assembly 110 (e.g., including support assembly 200 and container 300) and fastener assembly 400 may be removed from housing cavity 515. Container 300 may be removably attached to support assembly 200 (e.g., or container 300 may already be attached to support assembly 200 when disposed in housing cavity 515). Housing 500 may be removably attached to frame assembly 110 (e.g., to container 300) via connecting fasteners 395 and 595.

At step 815, apparatus 105 may be removably attached to weapon 600 and/or mount 700 using fastener assembly 400 for example as described above regarding FIGS. 7-12 and 15. For example, fasteners 410 and 420 may be fastened to support assembly 200 and weapon 600 (e.g., and mount 700) as described above.

At step 820, a user (e.g., an operator) may operate weapon 600, which may eject casings (e.g., casings and/or casing links) into apparatus 105 (e.g., into cavity 355 via opening 350) as weapon 600 is fired. At step 825, it may be determined (e.g., by the user and/or a second user) whether or not container 300 has reached a threshold capacity of spent casings and/or is substantially full and should be emptied. If container 300 is to be emptied, process 800 proceeds to step 830. Weapon 600 may continue to fire during steps 825 and 830.

At step 830, the user firing weapon 600 and/or a second user may detach flap portion 370 (e.g., by grasping handle 380 and opening container fastener 375) so that casings (e.g., casings 390 and/or casing links 392) fall out of cavity 355. Casings (e.g., casings 390 and/or casing links 392) may fall into housing cavity 515 of housing 500 when housing 500 is attached to container 300. Housing 500 may be detached (e.g., by detaching connecting fasteners 395 and 595) and removed from frame assembly 110 (e.g., from container 300), emptied, and then reattached to frame assembly 110 for example as described above. Alternatively, for example when housing 500 is not attached to container 300, spent casings (e.g., casings 390 and/or casing links 392) may fall to the ground or other surfaces below and/or around weapon 600 when flap portion 370 is detached. Process 800 may then return to step 820. Weapon 600 may continue to be operated for any desired length of time, with housing 500 being iteratively detached, emptied, and reattached to frame assembly 110 as weapon 600 is fired.

At step 835, it may be determined whether or not to remove (e.g., move) apparatus 105 from weapon 600 and/or mount 700. If apparatus 105 is not to be removed (e.g., moved), process 800 may return to step 820 and use of weapon 600 and apparatus 105 may continue as described above. When weapon 600 is no longer to be operated (e.g., at the end of a tactical operation) and/or apparatus 105 is no longer to be used, then it may be determined that apparatus 105 is to be removed (e.g., moved), and process 800 may proceed to step 840.

At step 840, apparatus 105 may be removed from weapon 600 and/or mount 700. For example, fasteners 410 and 420 of fastener assembly 400 may be removed from the locations described above regarding FIGS. 7-12 and 15.

At step 845, apparatus 105 may be stowed. Housing 500 may be removed from container 300 of frame assembly 110. Container 300 may be detached from support assembly 200, or alternatively container 300 may remain attached to support assembly 200. Frame assembly 110 (e.g., including support assembly 200 and container 300) and fastener assembly 400 may be disposed in housing cavity 515 of housing 500. Housing fastener 525 may be fastened to fasten housing cover 520 to housing body 510. Housing 500 containing the components of apparatus 105 may then be stored and/or transported as desired. Process 800 may end at step 850.

In at least some exemplary embodiments, the exemplary disclosed apparatus may be an apparatus for collecting spent ammunition casings (e.g., casings and/or casing links) from a weapon. The exemplary disclosed apparatus may include a support assembly (e.g., support assembly 200), a container (e.g., container 300) attached to the support assembly and forming a cavity configured to receive the ammunition casings (e.g., casings and/or casing links), and a fastener configured to be received in a portion of a mounting fixture of the weapon and removably attach the support assembly to the mounting fixture. The fastener may be either a replacement fastener or a modified fastener of a mounting fixture fastener of the weapon. The fastener may also be configured to be received in a mount portion of a mount to which the mounting fixture is configured to be attached. The fastener may be the modified fastener that has been modified to have an aperture drilled through the fastener, the aperture configured to receive a cotter pin of the fastener. The weapon may be an M249 SAW machine gun and the mounting fixture fastener may be an M249 SAW mounting fastener. The exemplary disclosed apparatus may also include a housing configured to be removably attachable to the container, the housing configured to store the support assembly, the container, and the fastener when detached from the weapon. The exemplary disclosed apparatus may further include a second fastener, wherein the fastener and the second fastener are configured to removably attach the support assembly to the weapon. The support assembly may contact the weapon at a first location of the fastener and a second location of the second fastener, the remainder of the support assembly being spaced away from the weapon. The container may be removably attachable to the support assembly. The exemplary disclosed apparatus may also include a container fastener disposed at the container and configured to detach at least a portion of a flap portion from the container to allow the ammunition casings (e.g., casings and/or casing links) to empty out of the container. The container may be configured to form an opening through which the ammunition casings (e.g., casings and/or casing links) are ejected from the weapon into the cavity. The support assembly may be formed from metal wires.

In at least some exemplary embodiments, the exemplary disclosed method may be a method for collecting spent ammunition casings (e.g., casings and/or casing links) from a weapon. The exemplary disclosed method may include providing a support assembly (e.g., support assembly 200), attaching a container (e.g., container 300) to the support assembly and forming a cavity configured to receive the ammunition casings (e.g., casings and/or casing links) when the container is attached to the support assembly, and removably attaching the support assembly to the weapon by inserting a fastener through a portion of a mounting fixture of the weapon and a portion of the support assembly. The fastener may be either a replacement fastener or a modified fastener of a mounting fixture fastener of the weapon. The exemplary disclosed method may also include inserting the fastener through a portion of a mount of a vehicle or a structure to which the mounting fixture is configured to be attached. The exemplary disclosed method may further include removably attaching a housing to the container and collecting the ammunition casings (e.g., casings and/or casing links) from the container in the housing when a container fastener of the container is opened. The exemplary disclosed method may also include detaching the housing from the container, emptying the housing of ammunition casings (e.g., casings and/or casing links) at a location away from the weapon, and reattaching the housing to the container. The exemplary disclosed method may further include stowing the support assembly, the container, and the fastener in the housing when the support assembly, the container, the fastener, and the housing are detached from the weapon. The exemplary disclosed method may also include machining the fastener that is the modified fastener to have an aperture drilled through the fastener before attaching the support assembly to the weapon, and receiving a cotter pin of the fastener through the aperture after attaching the support assembly to the weapon. The exemplary disclosed method may further include inserting a second fastener through a second portion of the weapon and a second portion of the support assembly, and except at a first location of the fastener and a second location of the second fastener, spacing the support assembly away from the weapon.

In at least some exemplary embodiments, the exemplary disclosed apparatus may be an apparatus for collecting spent ammunition casings (e.g., casings and/or casing links) from an M249 SAW machine gun. The exemplary disclosed apparatus may include a support assembly (e.g., support assembly 200), a container (e.g., container 300) removably attached to the support assembly and forming a cavity configured to receive the ammunition casings (e.g., casings and/or casing links), a fastener configured to be received in an aperture of a mounting fixture of the M249 SAW machine gun and removably attach the support assembly to the mounting fixture, and a housing configured to be removably attachable to the container. The fastener may be either a replacement fastener or a modified fastener of a mounting fixture fastener of the M249 SAW machine gun. The fastener may also be configured to be received in a mount aperture of a vehicle mount to which the mounting fixture of the M249 SAW machine gun is configured to be attached.

The exemplary disclosed system, apparatus, and method may provide a safe, efficient, and effective technique for collecting casings (e.g., casings and/or casing links). For example, the exemplary disclosed system, apparatus, and method may provide an efficient and effective technique for attaching an apparatus for collecting casings to a vehicle or other structure or assembly. Also for example, the exemplary disclosed system, apparatus, and method may provide an efficient and effective technique for collecting relatively large amounts of empty casings dispensed from a vehicle-mounted firearm.

It will be apparent to those skilled in the art that various modifications and variations can be made to the disclosed system, apparatus, and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. An apparatus for collecting spent ammunition casings from a weapon, comprising:

a support assembly;

a container attached to the support assembly and forming a cavity configured to receive the ammunition casings, wherein a portion of the container includes a flap portion;

a container fastener disposed at the container and configured to detach at least a portion of the flap portion from the container to allow the ammunition casings to empty out of the container; and a fastener configured to be received in a portion of a mounting fixture of the weapon and removably attach the support assembly to the mounting fixture, wherein the fastener is either a replacement fastener or a modified fastener of a mounting fixture fastener of the weapon.

2. The apparatus of claim 1, wherein the fastener is also configured to be received in a mount portion of a mount to which the mounting fixture is configured to be attached.

3. The apparatus of claim 1, wherein the fastener is the modified fastener that has been modified to have an aperture drilled through the fastener, the aperture configured to receive a cotter pin of the fastener.

4. The apparatus of claim 1, wherein the weapon is an M249 SAW machine gun and the mounting fixture fastener is an M249 SAW mounting fastener.

5. The apparatus of claim 1, further comprising a housing configured to be removably attachable to the container, the housing configured to store the support assembly, the container, and the fastener when detached from the weapon.

6. The apparatus of claim 1, further comprising a second fastener, wherein the fastener and the second fastener are configured to removably attach the support assembly to the weapon.

7. The apparatus of claim 6, wherein the support assembly contacts the weapon at a first location of the fastener and a second location of the second fastener, the remainder of the support assembly being spaced away from the weapon.

8. The apparatus of claim 1, wherein the container is removably attachable to the support assembly.

9. The apparatus of claim 1, wherein the container is configured to form an opening through which the ammunition casings are ejected from the weapon into the cavity.

10. The apparatus of claim 1, wherein the support assembly is a wire frame.

11. A method for collecting spent ammunition casings from a weapon, comprising:

providing a support assembly;

attaching a container to the support assembly to form a cavity configured to receive the ammunition casings when the container is attached to the support assembly;

removably attaching the support assembly to the weapon by inserting a fastener through a portion of a mounting fixture of the weapon and a portion of the support assembly, wherein the fastener is either a replacement fastener or a modified fastener of a mounting fixture fastener of the weapon; and opening a container fastener disposed on the container to detach at least a portion of a flap portion from the container to allow the ammunition casings to empty out of the container.

12. The method of claim 11, further comprising inserting the fastener through a portion of a mount of a vehicle or a structure to which the mounting fixture is configured to be attached.

13. The method of claim 11, further comprising removably attaching a housing to the container and collecting the ammunition casings from the container in the housing when a container fastener of the container is opened.

14. The method of claim 13, further comprising detaching the housing from the container, emptying the housing of ammunition casings at a location away from the weapon, and reattaching the housing to the container.

15. The method of claim 13, further comprising stowing the support assembly, the container, and the fastener in the housing when the support assembly, the container, the fastener, and the housing are detached from the weapon.

16. The method of claim 11, further comprising:

machining the fastener that is the modified fastener to have an aperture drilled through the fastener before attaching the support assembly to the weapon; and receiving a cotter pin of the fastener through the aperture after attaching the support assembly to the weapon.

17. The method of claim 11, further comprising:

inserting a second fastener through a second portion of the weapon and a second portion of the support assembly; and except at a first location of the fastener and a second location of the second fastener, spacing the support assembly away from the weapon.

18. An apparatus for collecting spent ammunition casings from an M249 SAW machine gun, comprising:

a support assembly;

a container removably attached to the support assembly and forming a cavity configured to receive the ammunition casings;

a fastener configured to be received in an aperture of a mounting fixture of the M249 SAW machine gun and removably attach the support assembly to the mounting fixture; and a housing configured to be removably attachable to the container;

wherein the fastener is either a replacement fastener or a modified fastener of a mounting fixture fastener of the M249 SAW machine gun.

19. The apparatus of claim 18, wherein the fastener is also configured to be received in a mount aperture of a vehicle mount to which the mounting fixture of the M249 SAW machine gun is configured to be attached.

20. An apparatus for collecting spent ammunition casings from a weapon, comprising:

a support assembly, wherein the support assembly includes a wire frame;

a container attached to the support assembly and forming a cavity configured to receive the ammunition casings, wherein a portion of the wire frame supports a portion of the container to form an opening into the cavity;

a fastener configured to be received in a portion of a mounting fixture of the weapon and removably attach the support assembly to the mounting fixture, wherein the fastener is either a replacement fastener or a modified fastener of a mounting fixture fastener of the weapon.

* * * * *